US009124034B2

(12) United States Patent
Köllmann et al.

(10) Patent No.: US 9,124,034 B2
(45) Date of Patent: Sep. 1, 2015

(54) TERMINAL HAVING AN OPERATING LEVER PIVOTABLY SUPPORTED ABOUT A ROTATIONAL AXIS

(71) Applicant: WAGO Verwaltungsgesellschaft mbH, Minden (DE)

(72) Inventors: Hans-Josef Köllmann, Minden (DE); Michael Meyer, Wiedensahl (DE); Wolfgang Gerberding, Hess. Olendorf (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 14/363,578

(22) PCT Filed: Dec. 11, 2012

(86) PCT No.: PCT/EP2012/075069

§ 371 (c)(1),
(2) Date: Jun. 6, 2014

(87) PCT Pub. No.: WO2013/087619

PCT Pub. Date: Jun. 20, 2013

(65) Prior Publication Data

US 2014/0370740 A1 Dec. 18, 2014

(30) Foreign Application Priority Data

Dec. 14, 2011 (DE) ..... 10 2011 056 410

(51) Int. Cl.

| | |
|---|---|
| ***H01R 4/48*** | (2006.01) |
| ***H01R 13/629*** | (2006.01) |
| ***H01R 13/42*** | (2006.01) |
| ***H01R 13/627*** | (2006.01) |
| *H01R 9/24* | (2006.01) |
| *H01R 107/00* | (2006.01) |

(52) U.S. Cl.

CPC ..... *H01R 13/62977* (2013.01); *H01R 4/4836* (2013.01); *H01R 13/42* (2013.01); *H01R 13/627* (2013.01); *H01R 9/24* (2013.01); *H01R 2107/00* (2013.01)

(58) Field of Classification Search

CPC .. H01R 13/62977; H01R 4/4836; H01R 9/24; H01R 2107/00; H01R 13/42; H01R 13/627

USPC ..... 439/438, 439, 441, 790, 816, 835

See application file for complete search history.

(56) References Cited

U.S. PATENT DOCUMENTS

| | | | | |
|---|---|---|---|---|
| 8,475,191 | B2 * | 7/2013 | Schafmeister | 439/266 |
| 8,651,890 | B2 * | 2/2014 | Chiarelli | 439/370 |
| 8,979,573 | B1 * | 3/2015 | Barber et al. | 439/441 |

FOREIGN PATENT DOCUMENTS

| | | | |
|---|---|---|---|
| DE | 1 898 970 | | 8/1964 |
| DE | 1 975 278 | | 12/1967 |
| DE | 87 04 494 | | 6/1987 |
| DE | 42 33 446 | C1 | 10/1993 |
| DE | 299 15 515 | U1 | 2/2001 |
| DE | 20 2009 010 003 | U1 | 1/2010 |
| EP | 1 622 224 | A1 | 2/2006 |
| JP | 2003249283 | A | 9/2003 |
| JP | 2004319394 | A | 11/2004 |

OTHER PUBLICATIONS

International Search Report dated Apr. 25, 2013 corresponding to application No. PCT/EP2012/075069.

* cited by examiner

*Primary Examiner* — Khiem Nguyen

(74) *Attorney, Agent, or Firm* — Renner, Otto, Boisselle & Sklar, LLP

(57) ABSTRACT

The invention relates to a terminal (1), comprising at least one bus bar piece (5), at least one clamping spring (4), which is bent into a U shape and has a clamping section (6) that points at an angle in the direction of an associated bus bar piece section (5*a*) of the bus bar piece (5) and forms a clamping point for an electrical conductor to be connected with a free clamping end and with the bus bar piece section (5*a*) in order to form a spring force clamping connection (3), an insulating-material housing (2), which has at least one conductor insertion opening (7) that leads to an associated spring force clamping connection (3) and extends in a conductor insertion direction (L), and at least one operating lever (8) pivotably supported about a rotational axis (D), which operating lever interacts with at least one clamping spring (4) by means of an operating section (9) in order to open at least one clamping point of an associated spring force clamping connection (3) when the operating lever (8) is pivoted and which has an operating arm (10) adjacent to the operating section (9). For each spring force clamping connection (3), two respective operating sections (9) opposite each other for accommodating an associated clamping section (6) of the clamping spring (4) of the associated spring force clamping connection are provided at least partially in the space between the opposite operating sections (9).

8 Claims, 4 Drawing Sheets

TERMINAL HAVING AN OPERATING LEVER PIVOTABLY SUPPORTED ABOUT A ROTATIONAL AXIS

Figure 1:
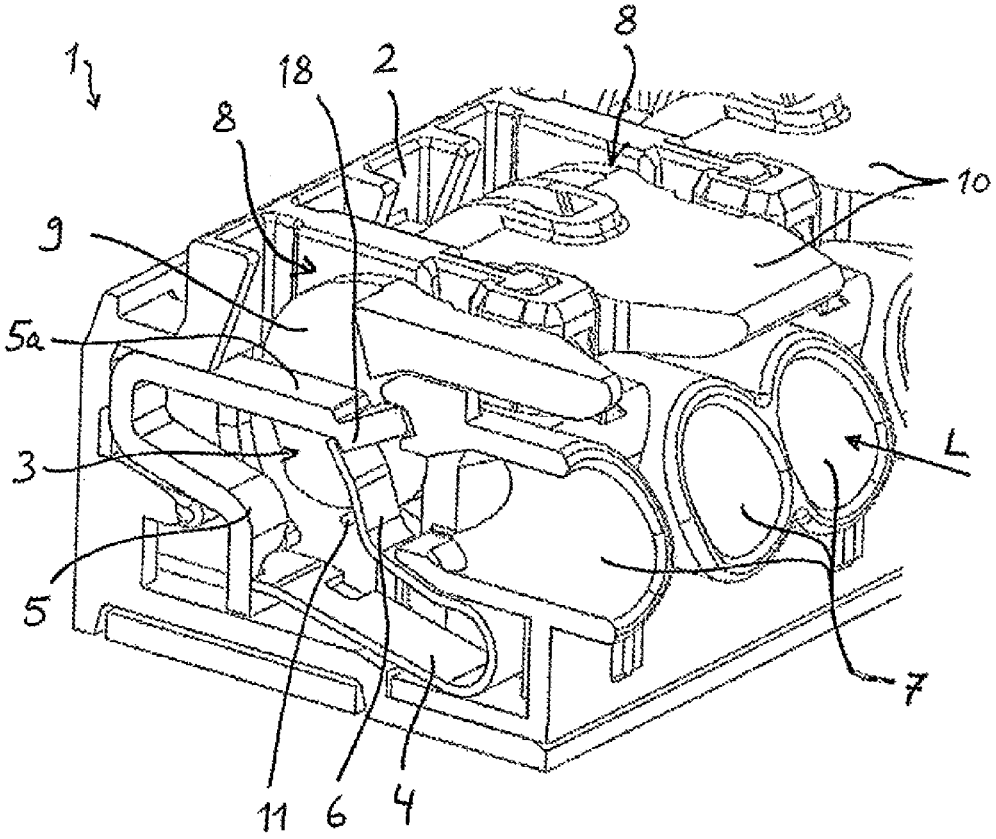

This application is a national phase of International Application No. PCT/EP2012/075069 filed Dec. 11, 2012.

The invention relates to a terminal comprising:

at least one bus bar piece and at least one clamping spring, which is bent into a U-shape and has a clamping section that points obliquely in the direction of an associated bus bar piece section of the bus bar piece and forms a clamping point for an electric conductor to be connected in order to form a spring clamping connection with a free clamping end and with the bus bar piece section, one insulating-material housing, which has at least one conductor introduction opening that leads to an associated spring force clamping connection and extends in a conductor introduction direction, and at least one operating lever pivotably mounted about a rotational axis, which operating lever is formed so as to interact with at least one clamping spring by means of an operating section in order to open at least one clamping point of an associated spring force clamping connection when the operating lever is pivoted and which has an operating arm adjacent to the operating section.

DE 299 15 515 U1 discloses a spring clamp for connecting electric conductors to an insulating-material housing which has a connecting chamber with a clamping spring which interacts with a bus bar piece. An operating element in the form of an eccentric lever is integrated into the insulating-material housing, which eccentric lever is mounted rotatably in the insulating-material housing. The rotational axis of the eccentric lever lies substantially perpendicular above the clamping point.

DE 87 04 494 U1 discloses a terminal with a spring force clamping connection and an operating lever. The operating lever is mounted pivotably behind the clamping point below the clamping spring as seen with its rotational axis in the conductor insertion direction. An operating strap is bent at the free clamping leg end, which operating strap interacts with an operating finger of the operating lever for opening of the spring force clamping connection.

Proceeding from this, the object of the present invention is to create an improved terminal, which has as small a design as possible, with a spring force clamping connection and operating lever which is also improved in terms of the force effect of the operating lever on the terminal.

The object is achieved by the terminal with the features of claim 1.

In the case of a generic terminal of the above-mentioned type, in each case two operating sections opposite each other for accommodating an associated clamping section of the clamping spring of the associated spring force clamping connection are provided for each spring force clamping connection at least partially in the space between the opposite operating sections. A contour for loading the associated clamping spring is present on at least one operating section of a pair of operating sections opposite each other for a spring force clamping connection. The rotational axis of the operating lever extends transverse to the conductor introduction direction defined by the conductor introduction opening and lies in the space between the plane formed by the bus bar piece section which forms the clamping point and a plane parallel to this, in which the clamping edge of the clamping spring lies when the clamping spring is fully opened by pivoting the operating lever.

As a result of the arrangement of the operating lever with its rotational axis in the conductor introduction opening or in alignment with the conductor introduction opening towards the clamping point, the rotation of the operating lever is carried out in the region of the clamping point or in the space in front of it. This has the advantage that the operating lever can also be received in the insulating-material housing in a manner which saves space and at the same time serves as a wall of the conductor introduction channel for guiding an electric conductor. The operating lever thus replaces a part of the guide wall for an electric conductor of the conductor introduction opening.

Moving the rotational axis into the region of the clamping point or in alignment with the conductor introduction opening which lies in front thereof also has the kinematic advantage that operation of the clamping spring is carried out relatively close to the rotational axis which reduces the lever forces on the insulating-material housing.

The operating lever on both sides advantageously provides a lateral restricting wall for guiding an electric conductor, which is introduced in the conductor introduction direction into a conductor introduction opening, to an associated clamping point. As a result of the operating sections arranged on both sides of a respective spring force clamping connection, a U-shaped operating lever is created which is rotationally fixed and enables good rotational mounting in the insulating-material housing. The at least one clamping spring is configured as a clamping spring bent in a U-shape, the free clamping section of which points obliquely in the direction of an associated bus bar piece. Direct clamping of an electric conductor is possible without previously opening the clamping spring with the associated operating lever with the help of such a clamping spring which is bent in a U-shape. This is also referred to as the direct connection technique.

The bus bar in the section which forms the clamping point defines, irrespective of any raised sections for a contact edge, a first plane in relation to which a second imaginary plane is formed. This second plane is spaced apart from the plane of the bus bar piece in such a manner that the clamping edge of an open clamping spring contacts this plane. The intermediate space between the planes forms the preferred space in which the rotational axis of the operating lever should be in order to provide a very compact, mechanically stable terminal.

It is particularly advantageous if at least one operating lever plunges into a cut-out of the bus bar piece, which cut-out is made adjacent to a clamping section of the associated bus bar piece. The operating lever then loads, by means of an operating section, an operating lug arranged as seen across the width of an associated clamping spring next to the clamping section of the clamping spring for opening of the clamping spring. It is possible to accommodate the operating lever in a space-saving manner with the help of the cut-out at a side edge of the bus bar piece. As seen across the width of the bus bar piece and the associated clamping spring, an operating lug is then produced on the clamping section of the clamping spring below this cut-out, which operating lug is then loaded by the operating section of the operating lever during pivoting of the operating lever in order to open the clamping spring. Electric contact of an electric conductor is then carried out adjacent to this cut-out of the bus bar piece or as seen across the width adjacent to the operating lug by the clamping section of the clamping spring and a preferably advanced contact edge of the bus bar piece.

The operating lug is preferably released from the clamping spring, e.g. by free punching or free cutting, and projects obliquely from the clamping section of the clamping spring.

The at least one operating lever preferably has an operating arm which extends in the conductor insertion direction in the closed state of the associated spring force clamping connection. The free end of the operating arm thus ends opposite the conductor insertion opening in the region of the rear side of the terminal. A very compact design of the terminal is thus possible.

It is, however, also conceivable that the at least one operating lever has an operating arm which extends on the underside or the upper side of the terminal in the conductor insertion direction or opposite thereto. In particular, combinations in which operating arms of the operating levers extend alternately in the conductor insertion direction and opposite thereto or extend alternately on the underside and upper side in the same directions or alternately in opposite directions are conceivable for variants of the terminal which have as small a design as possible.

These embodiments are in particular dependent on the concrete combination of spring force terminals and their spatial position to one another.

In one preferred embodiment in this regard, the terminal has at least one pair of spring force terminals which are opposite each other with conductor introduction openings which run towards each other on the mutually opposing front side and rear side of the terminal. In the case of this embodiment, electric conductors can thus be inserted both from the front side and from the rear side of the terminal in opposite conductor introduction directions and are contacted with associated spring force terminals. Each spring force terminal of such a pair with opposite, possibly offset conductor introduction openings has in each case an operating lever with an operating arm, the operating arms of which point in opposite directions from one another.

The operating arms are preferably received in the space between two conductor introduction openings above or below the conductor introduction opening on the upper side or lower side of the terminal in associated recesses of the insulating-material housing.

In the case of this embodiment, it is particularly advantageous if the operating arms of a pair of operating levers are arranged on the same side or alternatively on opposite sides of the terminal.

Figure 2:
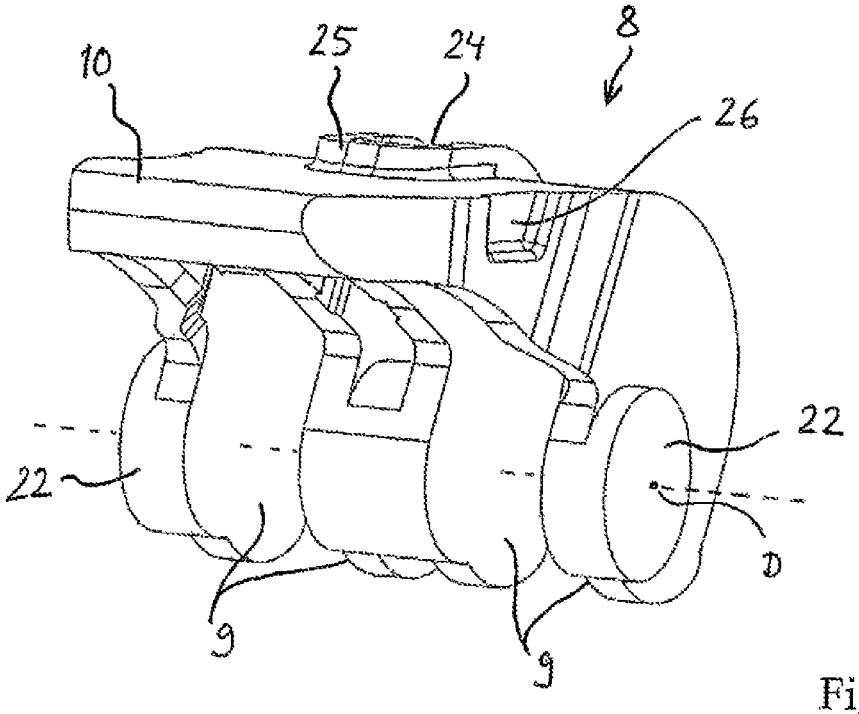
Figure 3:
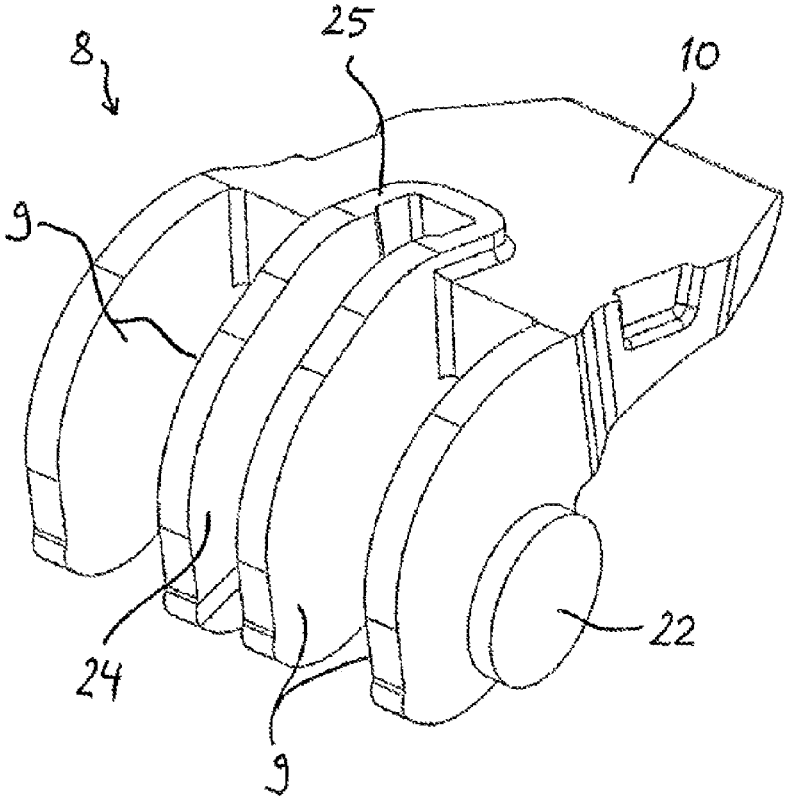
Figure 4:
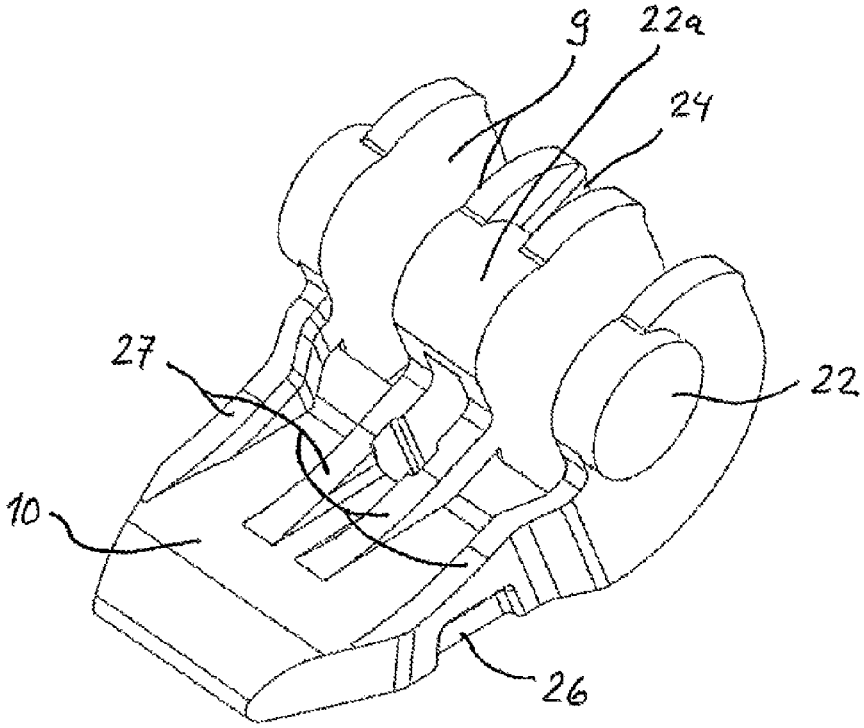
Figure 5:
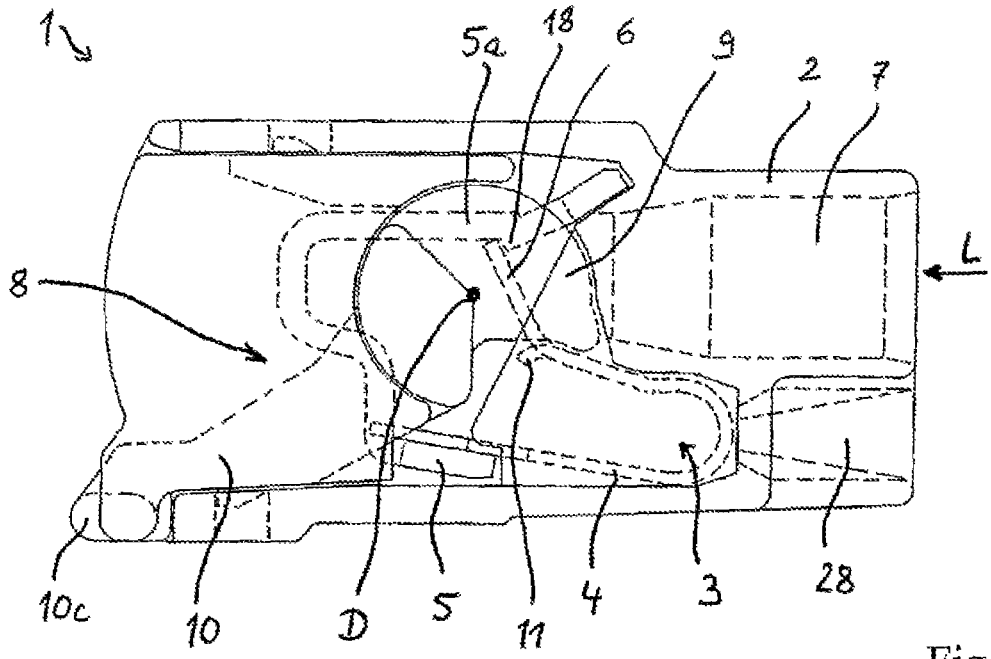
Figure 6:
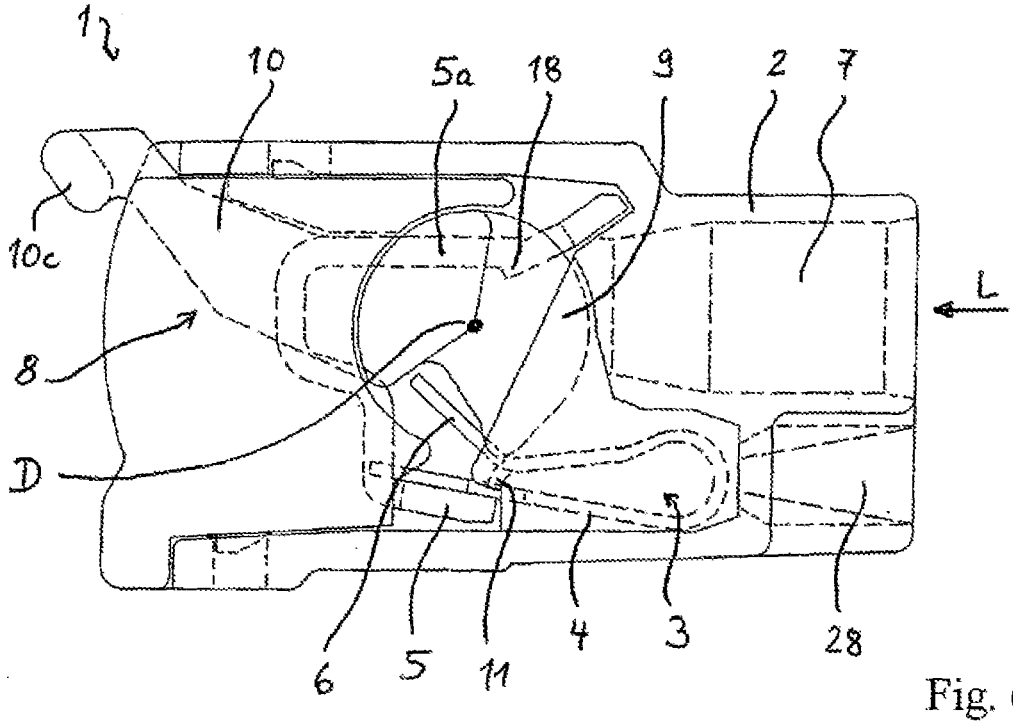
Figure 7:
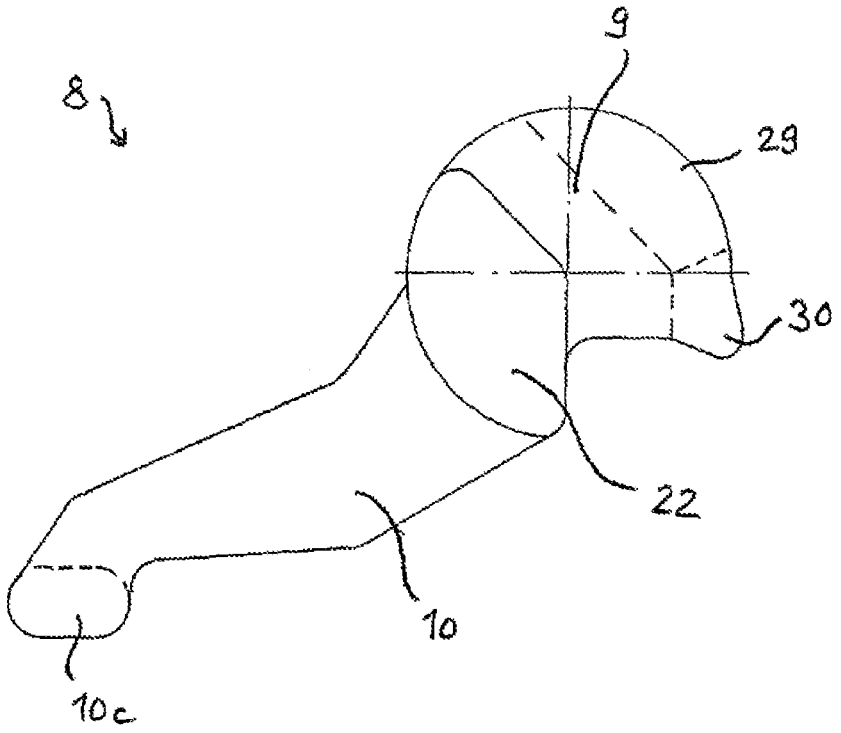
Figure 8:
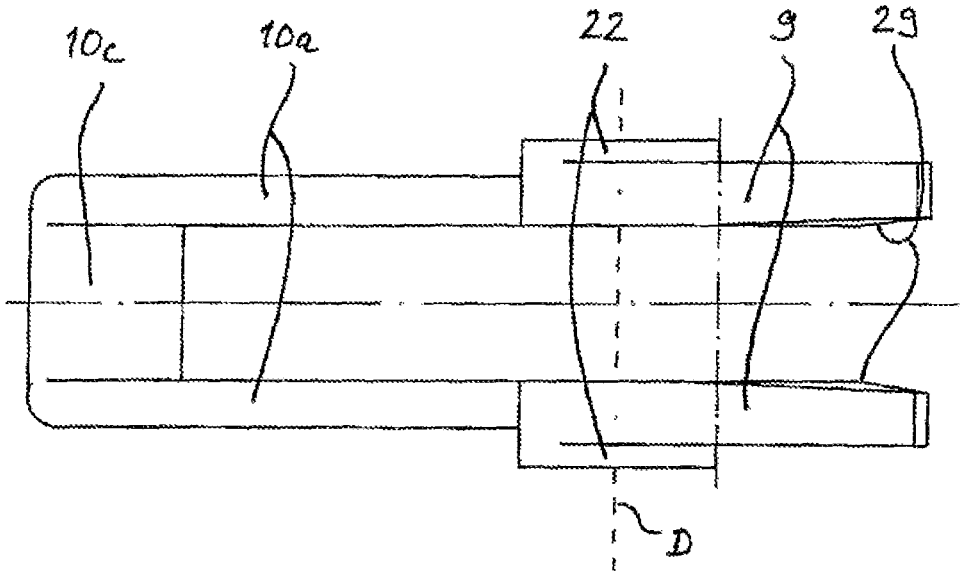

The invention is explained in greater detail below on the basis of exemplary embodiments with the enclosed drawings. In these drawings:

FIG. 1—shows a perspective sectional partial view of a multi-row terminal as a terminal block;

FIG. 2—shows a perspective representation of an operating lever for the terminal from FIG. 1;

FIG. 3—shows a perspective rear side view of the operating lever from FIG. 2;

FIG. 4—shows a perspective view of the operating lever from FIGS. 2 and 3 from below;

FIG. 5—shows a side sectional view of another embodiment of a multi-row terminal in the form of a terminal block with operating levers, which are directed to the rear, in the closing position;

FIG. 6—shows a side sectional view of the terminal from FIG. 5 with an operating lever in the open position;

FIG. 7—shows a side view of an operating lever of the terminal from FIGS. 5 and 6;

FIG. 8—shows an overview of the underside of the operating lever from FIG. 7.

FIG. 1 thus shows one embodiment of a multi-row terminal 1 in the form of a terminal block. Said terminal 1 has a plurality of spring force clamping connections 3 which lie next to one another and are connected to one another in an electrically conducting manner and of which the left-hand one is visible. It is apparent that a clamping spring 4 is suspended in a bus bar piece 5. Clamping spring 4 is bent in a U-shape so that a clamping section 6 protrudes with a clamping edge at the free end for the formation of a clamping point against bus bar piece section 5*a*. In the unloaded state without a clamped electric conductor, the clamping edge lies on bus bar piece section 5*a*.

Each spring force clamping connection 3 provides a clamping point by means of a clamping section 6 formed at the free, movable end of the clamping spring and in particular by means of the clamping edge at the free end of clamping spring 4 and on bus bar piece section 5*a* which is opposite clamping section 6. An associated conductor introduction opening 7 is incorporated in the insulating-material housing for each spring force clamping connection 3 for introduction of an electric conductor to the clamping point. Conductor introduction opening 7 has a diameter which is adapted to the largest possible admissible cross section including the insulating-material casing of an electric conductor.

For opening of clamping springs 4, each spring force clamping connection 3*a*, 3*b* has an operating lever 8 with an operating section 9 and an operating arm 10 which is adjacent thereto and extends in a longitudinal direction.

Operating levers 8 are shown in the closing position of the clamping points. Operating levers 8 can be pivoted by approximately 90° from the closing position to the open position. To this end, operating levers 8 are arranged with their operating sections 9 and in particular rotational axis D, about which respective operating lever 8 is pivotably mounted in insulating-material housing 2 of the terminal, in the space of associated conductor introduction opening 7 or in conductor introduction direction L to the clamping point in the further extension of conductor introduction opening 7.

It is furthermore apparent that, as seen in the direction of the width of clamping spring 4, next to clamping section 6, in each case one operating lug 11 is released and projects obliquely from clamping section 6. An adapted contour of operating section 9 of associated operating lever 8, during pivoting of operating lever 8 from the closing position to the open position, loads said operating lug 11 at least partially during the movement process. In this manner, clamping portion 6 of clamping spring 4 is moved away from adjacent bus bar piece section 5*a* which forms the clamping point in order to open clamping spring 4.

In the case of this embodiment, clamping spring 4 can have operating lugs 11 on both sides of clamping section 6.

It is clear that bus bar piece section 5*a*, which forms the clamping point, has at its free end a clamping projection 18 by means of which a defined bearing surface, which is reduced in terms of its surface area, for an electric conductor is created. The clamping force of clamping spring 4 is then concentrated via the electric conductor on this clamping surface defined by clamping projection 18 so that the surface pressure is increased in comparison to a planar bearing surface. It is furthermore clear that the free end of bus bar piece portion 5*a*, which forms the clamping point, is angled obliquely upwards in order to provide a guide for an electric conductor to clamping edge 18.

Bus bar piece section 5*a*, which forms the clamping point, can optionally (not shown) have a cut-out in the form of a depression laterally adjacent to clamping edge 18, into which depression operating section 9 of operating lever 8 plunges. Across the width of clamping spring 4, operating lug 11 is then released from clamping section 6 of clamping spring 4 below said cut-out 19 and extends in the direction of conductor introduction direction L.

It is clear that the side walls of operating section 9 of operating lever 8 for an electric conductor introduced to the clamping point forms a lateral delimiting wall which is used to guide the electric conductor to the clamping point.

Bus bar pieces 5 of spring force clamping connections 3 arranged as seen in the viewing direction obliquely to the right behind one another can be connected to one another in an electrically conductive manner. However, an embodiment of connecting terminal 1 is also conceivable in which in each case two spring force clamping connections 3 lying next to one another are connected to one another in an electrically conductive manner and two or three pairs of such spring force clamping connections 3 which are connected to one another in an electrically conductive manner are provided. In each case two conductors can be connected in each case to one another for a single-phase voltage supply connection with connections L (phase), N (neutral conductor) and PE (Earth) so that a mains supply terminal is formed.

It is clear that operating levers 8 are arranged in each case next to the clamping points, i.e. next to bus bar piece section 5*a* and clamping section 6 immediately behind the end of conductor introduction opening 7 formed in insulating-material housing 2. Operating sections 9 of operating levers 8 form a continuation of the wall of respective conductor introduction opening 7 in order to guide an electric conductor to the clamping point. Each operating section 9 interacts with an associated operating lug 11 of clamping spring 4. The rotational axis of operating levers 8 lies below bus bar piece section 5 in the region of the clamping point. The rotational axis extends transverse to the conductor insertion direction which is specified by the direction of extension of conductor introduction opening 7.

It is also clear that operating arms 10 extend counter to conductor insertion direction L and are arranged on the upper side of insulating-material housing 2. The free ends of operating arms 10 lie in the region of the front side. The free ends of operating arms 10 are spaced apart from the delimiting walls of conductor introduction opening 7 or insulating-material housing 2 in such a manner that they can be gripped and pivoted by hand.

It is furthermore apparent that operating lever 8 is received in recesses of insulating-material housing 2 in order to receive a part of operating arm 10. Operating arm 10 thus extends in the closing position counter to conductor introduction direction L to the respective front side of associated conductor introduction opening 7 of insulating-material housing 2.

An embodiment is optionally also conceivable in which operating arm 10 is rotated by 180° and points in conductor introduction direction L in the closing position.

It is apparent from FIG. 1 in particular on the basis of conductor introduction openings 7 shown in the center with adjacent operating lever 8 that an operating lever 8 is provided in the case of the exemplary embodiment in each case for opening two spring force clamping connections 3 which lie next to one another. Alternatively, in each case one operating lever 8 can also be provided for each clamping point.

FIG. 2 shows a perspective view of such an operating lever 8 from the front side. It is also clear here that an opening 24 is present in the middle, central region, into which opening 24 a guide wall of the insulating-material housing plunges in order to guide operating lever 8 in insulating-material housing 2 so as to prevent tilting. Opening 24 is surrounded in the upper region by a circumferential collar 25. This serves to strengthen and reinforce operating lever 8.

It is furthermore apparent that operating lever 8 has a swivel pin 22, which serves as a bearing, on both lateral outer ends. Swivel pins 22 are accommodated in corresponding openings in insulating-material housing 2.

It is furthermore apparent that, for each spring force clamping connection 3, in each case two opposite operating sections 9 are provided so that an electric conductor is guided on both sides on said operating sections 9 to the clamping point, once the electric conductor exits from laterally, circumferentially delimited conductor introduction opening 7 to the clamping point out of conductor introduction opening 7.

Opposite operating sections 9 thus serve as a continuation of conductor introduction opening 7.

On opposite side edges of operating arms 10, operating levers 8 can have latching grooves 26 or projecting latching pins in order to lock the operating lever in the closed state with insulating-material housing 2 and prevent unintentional opening of operating levers 8 with reduced force.

FIG. 3 shows the operating lever from FIG. 2 in the rear side view. Opening 24 embodied as a slot in the center of operating lever 8 is apparent.

Collar 25 which is circumferential on the upper side of operating arm 10 is also apparent, said collar 25 forming a transition into the walls which form operating sections 9 with opening 24 (slot) which is located therebetween.

FIG. 4 shows a perspective view of the operating lever from FIGS. 2 and 3 from the underside. It is clear here that opening 24 is closed again in the lower region. It is also apparent that the walls which form operating sections 9 form a transition via webs 27 on the underside of operating arm 10 into these in order to reinforce operating arm 10 and prevent rebounding relative to operating sections 9. Operating sections 9 have a contour which is adapted to rotational axis D such that opened operating lever 8 remains self-locking in a top dead center position.

It is furthermore apparent that, in addition to swivel pins 22 in the middle region, a guide surface 22*a* for mounting is present.

FIG. 5 shows a further embodiment of a terminal 1 with a plurality of spring force clamping connections 3 arranged one behind the other in the viewing direction and associated operating levers 8. In the representation, operating lever 8 is shown in the closing position in which the clamping spring 4 of spring force clamping connection 3 is closed.

FIG. 6 shows the same operating lever 8 in the open position in which spring force clamping connection 3 is opened.

It is clear that operating lever 8 with its operating sections 9 is arranged immediately behind conductor introduction opening 7 in turn on both sides laterally next to bus bar piece 5 or bus bar piece section 5*a* which forms the clamping point. Rotational axis D in turn lies in conductor introduction opening 7 or directly behind it and as seen in conductor introduction direction L shortly in front of the clamping point and below bus bar piece section 5*a* which forms the clamping point. Operating arms 10 of operating levers 8 are directed in conductor introduction direction L away from conductor introduction openings 7 in the direction of the rear side of terminal 1. A very compact structure of connecting terminal 1 is thus enabled with a simple and reliable operation of spring force clamping connection 3.

It is furthermore apparent that a test opening 28, which is open to clamping spring 4, is provided on the front side of insulating-material housing 2 in the lower region. In this manner, the voltage potential present at the spring force clamping connection can be measured with the help of a test pin introduced into test opening 28.

FIG. 7 shows a side view of operating levers 8 of terminal 1 from FIGS. 5 and 6. It is clear that operating arm 10 protrudes from the operating sections 9 initially obliquely to the left and then in conductor introduction direction L. Transverse piece 10*c* at the lower free end of operating arm 10 is also apparent.

Self-retention of opened operating lever 8 in a top dead center position can be achieved by a suitable contour of the operating section in accordance with the position of rotational axis D.

Operating sections 9 have, for this purpose, e.g. a nose 30 which is matched to the position of the rotational axis such that opened operating lever 8 remains self-locking in a top dead center position.

FIG. 8 shows an overview of the operating arm from FIG. 11 from below. Here, the structure of operating arm 10 with two arm sections 10*a*, 10*b* and transverse piece 10*c* which connects arm sections 10*a*, 10*b* at the free end is clear.

It is also apparent that swivel pins 22 protrude laterally on the outer sides of operating sections 9, which swivel pins 22 are mounted in corresponding recesses of insulating-material housing 2 of terminal 1.

It is furthermore apparent that opposite inner sides of operating sections 9 are positioned obliquely towards the free end and have introduction bevels 29 for guiding an electric conductor without interfering edges.

Further variants are conceivable as an alternative to the terminal block shown. This applies in particular to variants of terminals in which as seen over the length of the terminal two spring force clamping connections 3 which lie one behind the other are provided. In order to save installation space, it may be advantageous if operating levers 8 protrude in an alternating manner as seen across the width at the rear side and underside.

A variant is also conceivable in which operating arms 10 protrude in an alternating manner on one hand in the conductor introduction direction and in the case of spring force clamping connection 3 which lies next to it protrude counter to conductor introduction direction L from the rear side or front side.

Yet another variant is conceivable where not only the direction of operating arms 10 change in an alternating manner, but the alignment of the operating levers are also alternating such that they protrude out of the upper side and adjacently out of the underside of insulating-material housing 2 or are received in recesses on the upper side and alternately the lower side.

The invention claimed is:

1. A terminal comprising:

at least one bus bar piece at least one clamping spring, which is bent into a U-shape and has a clamping section that points obliquely in the direction of an associated bus bar piece section a of the bus bar piece and forms a clamping point for an electric conductor to be connected in order to form a spring force clamping connection with a free clamping end and with the bus bar piece section, an insulating-material housing, which has at least one conductor introduction opening that leads to an associated spring force clamping connection and extends in a conductor introduction direction, and at least one operating lever pivotably mounted about a rotational axis, which operating lever is formed so as to interact with at least one clamping spring by means of an operating section in order to open at least one clamping point of an associated spring force clamping connection when the operating lever is pivoted and which has an operating arm adjacent to the operating section, wherein for each spring force clamping connection, two respective operating sections opposite each other for receiving an associated clamping section of the clamping spring of the associated spring force clamping connection are provided at least partially in the space between the opposite operating sections, a contour for loading the associated clamping spring is present on at least one operating section of a pair of operating sections opposite each other for a spring clamping connection, the rotational axis of the operating lever extends transverse to the conductor introduction direction defined by the conductor introduction opening and lies in the space between the plane formed by the bus bar piece section which forms the clamping point and a plane parallel to this, in which the clamping edge of the clamping spring is located when the clamping point is fully opened by pivoting the operating lever.

2. The terminal as claimed in claim 1, wherein at least one operating lever plunges into a cut-out of the bus bar piece, which cut-out is made adjacent to a clamping section of the associated bus bar piece, and, with the contour of the operating section, loads an operating lug arranged as seen across the width of an associated clamping spring next to the clamping section of the clamping spring for opening of the clamping spring.

3. The terminal as claimed in claim 1, wherein an operating lug arranged as seen across the width of an associated clamping spring next to the clamping section of the clamping spring for opening of the clamping spring is present and this operating lug is released from the clamping spring and protrudes obliquely from the clamping section of the clamping spring.

4. The terminal as claimed in claim 1, wherein the at least one operating lever has an operating arm which extends opposite to the conductor insertion direction in the closed state of the associated spring force clamping connection.

5. The terminal as claimed in claim 1, wherein the at least one operating lever has an operating arm which extends on the underside or upper side of the connecting terminal in the conductor insertion direction or opposite thereto.

6. The terminal as claimed in claim 1, wherein the terminal has at least one pair of spring force terminals which are opposite each other with conductor introduction openings which run towards each other on the opposite front side and rear side of the terminal, wherein each spring force terminal of one pair is assigned in each case an operating lever with an operating arm, the operating arms of which point in opposite directions from one another.

7. The terminal as claimed in claim 6, wherein the operating arms of a pair of operating levers are arranged on the same side or on opposite sides of the terminal.

8. The terminal as claimed in claim 1, wherein the projecting contour of the operating section is matched to the position of the rotational axis and the clamping spring such that the opened operating lever remains self-locking in a top dead center position.

* * * * *